US005539506A

United States Patent [19]

Bean et al.

[11] Patent Number: 5,539,506

[45] Date of Patent: Jul. 23, 1996

[54] EDGE RAGGEDNESS AND BACKGROUND REMOVAL BY POST DEVELOPMENT MEMBER

[75] Inventors: Lloyd F. Bean, Rochester; Victor Berko-Boateng, Penfield, both of N.Y.

[73] Assignee: Xerox Corporation, Stamford, Conn.

[21] Appl. No.: 328,798

[22] Filed: Oct. 31, 1994

[51] Int. Cl.[6] ..... G03G 15/06

[52] U.S. Cl. ..... 355/261; 355/266; 355/328

[58] Field of Search ..... 355/245, 261, 355/265, 266, 328

[56] References Cited

U.S. PATENT DOCUMENTS

| | | | |
|---|---|---|---|
| 3,457,900 | 7/1969 | Drexler | 118/637 |
| 4,078,929 | 3/1978 | Gundlach | 96/1.2 |
| 4,348,098 | 9/1982 | Koizumi | 355/274 |
| 4,468,110 | 8/1984 | Tanigawa et al. | 355/268 |
| 4,701,042 | 10/1987 | Mimura et al. | 355/265 |
| 4,847,655 | 7/1989 | Parker et al. | 355/210 |
| 5,258,820 | 11/1993 | Tabb | 355/328 |
| 5,351,113 | 9/1994 | Pietrowski et al. | 355/273 |

*Primary Examiner*—Nestor R. Ramirez
*Attorney, Agent, or Firm*—William A. Henry, II

[57] ABSTRACT

An apparatus for removing the edge raggedness and background toner level of, for example, tri-level images by reestablishing the images and cleaning fields of the first developed image with a closely spaced electrode. The toner is redistributed by electrical and/or mechanical forces which leads to the removal of edge raggedness and background toner before transfer of the tri-level images to a copy sheet.

23 Claims, 2 Drawing Sheets

EDGE RAGGEDNESS AND BACKGROUND REMOVAL BY POST DEVELOPMENT MEMBER

BACKGROUND OF THE INVENTION

This invention relates generally to the rendering of latent electrostatic visible using single and multiple colors of dry toner and, more particularly, to a developer apparatus including structure for ensuring and restoring the development of the edges and reducing the solid area image noise (due to carrier development in two component development systems) of the previously developed images.

Development of electrostatic images is currently available through the use of a wide variety of development systems, such as, monochrome development systems which use a single color toner and no carrier; two component development systems that employ both toner and carrier materials; and three component systems that make images visible with toner, carrier and an additive.

An example of two component development is described in the concept of tri-level xerography in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negatively and relatively positive toner particles. Such a developer is generally supplied to the charge pattern by cascading it a cross the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged area development, i.e. CAD) stays at the full photoreceptor potential. The other image is exposed to discharge the photoreceptor to its residual potential, (typically 100 v) which corresponds to discharged area images that are subsequently developed by discharged-area development (DAD).

Various techniques have heretofore been employed to develop electrostatic images as illustrated by the following disclosures which may be relevant to certain aspects of the present invention and are incorporated herein by reference, as well as the references cited in them, to the extent necessary to practice the present invention.

As disclosed in U.S. Pat. No. 3,457,900, magnetic brushes have been designed to give fringe field or solid area development by adjusting the conductivity of the carrier. It is also stated therein that they can also be made to tone areas of less charge and clean areas of greater charge giving what is known in the art as a reverse development.

U.S. Pat. No. 4,847,655 discloses a highlight color imaging apparatus which includes magnetic brush development system that has a plurality of developer housings each including a plurality of magnetic brush rolls associated therewith. Conductive magnetic brush (CMB) developer is provided in each of the developer housings. The CMB developer is used to develop electronically formed images. The physical properties such as conductivity, toner concentration and toner charge level of the CMB developers are such that density fine lines are satisfactorily developed notwithstanding the presence of relatively high cleaning fields.

But even with these and other developer techniques, it has been found that two component development of the second color image in tri-level highlight color (lines and solids) often produces ragged edges of images and high background toning. The first developed image of a tri-level copy (or print) is degraded by the second development process. This degradation is most severe when the toner concentration of the first developer increases and the triboelectricity decreases. This degradation is noticed the most on the lead edge of lines that are perpendicular to the process direction. The lead edges of the perpendicular lines are ragged and have a higher level of background toner due to toner particles sprayed from the lines or solids.

The present invention aims at improving image edge smoothness, solid area granularity, and background cleanliness in two component development copier/printers by providing a process and apparatus whereby electrical and/or mechanical forces (such as ultrasonic or AC biased electrodes) are supplied so that the toner can rearrange itself according to the electric fields from the image.

SUMMARY OF THE INVENTION

Accordingly, the present invention in a two component development copier/printer, provides after development of an image, a post redevelopment process to redistribute the toner contained in the line image and adjacent areas and remove remaining edge background toner.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the low cost, edge raggedness, solid granularity and background removal apparatus and method in a copier/printer. However, it should be understood that the method and apparatus of the present invention could be used with any machine in which removal of image edge raggedness or fringe fields is desired regardless as to whether single component, two component or three component development systems are employed and the tri-level embodiment discussed hereinbelow is exemplary only and is not to be view as limiting the invention in any way.

Figure 1:
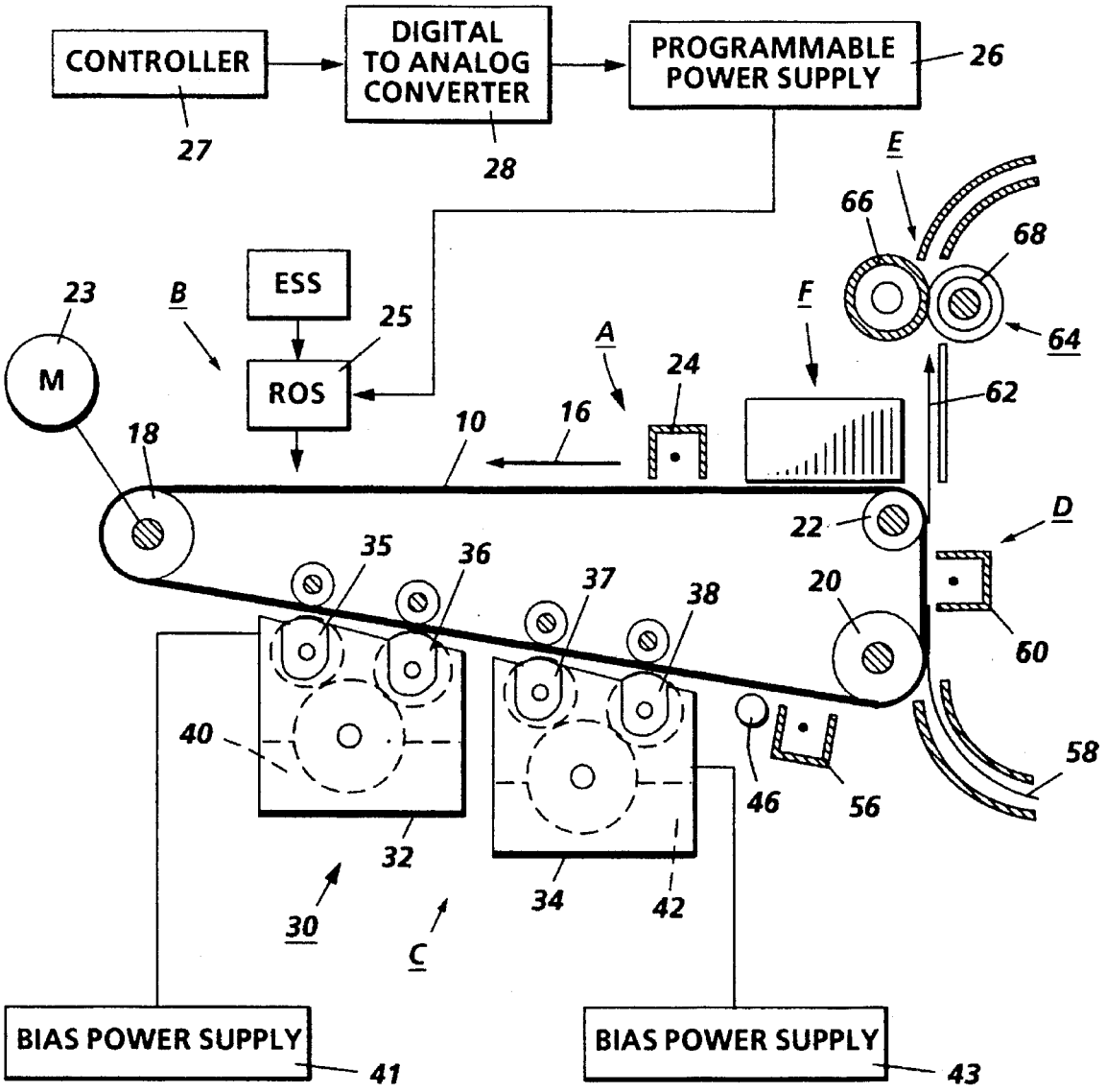
FIG. 1 is a schematic of a printing apparatus employing an edge raggedness and background removal apparatus and method in accordance with the present invention.

As shown in FIG. 1, a printing machine incorporating the present invention may utilize a charge retentive member in the form of a photoconductive belt 10 consisting of a photoconductive surface and an electrically conductive substrate and mounted for movement past a charging station A, an exposure station B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_o$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charged retentive surface to be discharged in accordance with the output from the scanning device. Preferably the scanning device is a three level laser Raster Output Scanner (ROS). The ROS output is set via a programmable power supply 26 which driven by means of a controller 27 via a digital to analog converter 28. Alternatively, the ROS could be replaced by a conventional xerographic exposure device.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage, the direction of offset depending on the polarity of toner in the housing. One housing e.g. 32 (for the sake of illustration, the first) contains developer with black toner 40 having triboelectric properties such that the toner is driven to the most highly charged areas of the latent image by the electrostatic field (development field) between the photoreceptor and the specifically biased development rolls. Conversely, the triboelectric charge on colored toner 42 in the second housing is chosen so that the toner is urged towards parts of the latent image at residual potential by the electrostatic field (development field) existing between the photoreceptor and the development rolls in the second housing at a predetermined bias.

Degradation of an image on the photoreceptor is reversed in accordance with the present invention by creating a redevelopment process that is activated after the second (highlight) image has been placed on the photoconductive belt 10 to redistribute the toner contained in the line image areas and remove any remaining lead edge background toner. This is accomplished by applying a D.C. biased A.C potential to conductive, post redevelopment member or electrode 46 that is positioned in close proximity (0.001 inches to 0.030 inches) to the developed image on the photoconductive belt 10. This placement is such that the toner particles jump back and forth between electrode 46 and the photoconductive belt 10. During this process, the toner is redistributed within the image in accordance with the electric fields associated with the image, thereby redefining the edges of the image and removing the image noise background toner.

The D.C. bias that is applied to post redevelopment electrode 46 is believed to create a cleaning electric field for background toner of the first developed image and should not require cleaning because the toner deposited on it is deposited in subsequent first developed images areas. The electrode 46 may be coated with a material that triboelectrically recharges the toner of the second developed image. During the post development process mentioned hereinbefore, the toner from the second development system (wrong sign) that resides in the first developed image area is recharged to the right polarity and removed. Electrode 46 is configured so that electric dipole fields exist at its surface. These dipole fields will remove low charged toner from both the first and second developed images. The presence of low charged toner particles in the developer (hence the developed images) are the primary cause of line broadening. The removal of these low charged particles reduces line broadening.

Figure 2:
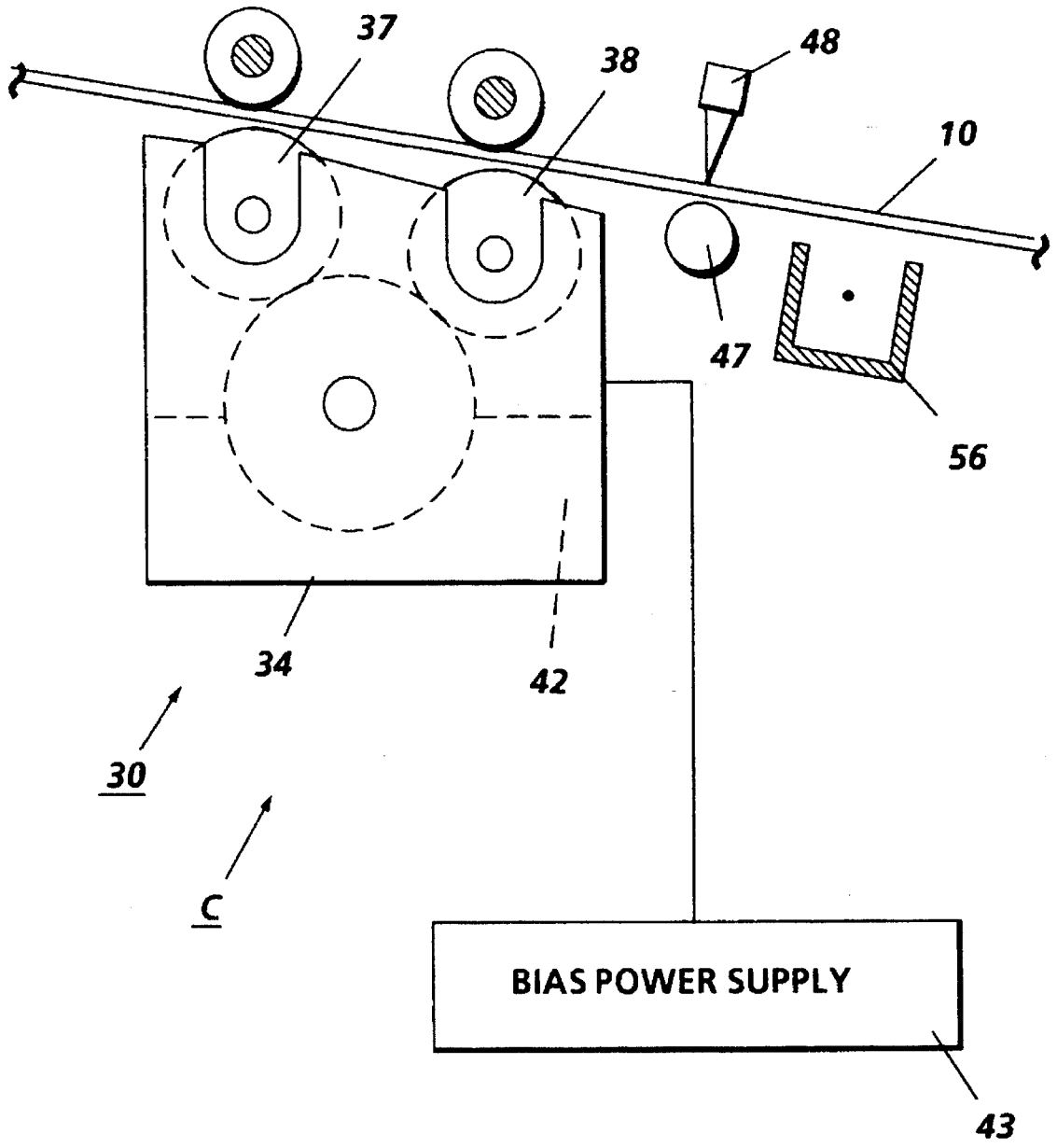
FIG. 2 is an schematic of an alternative embodiment of the present invention that incorporates an ultrasonic probe.

An alternative embodiment of the edge raggedness and background removal apparatus of the present invention is shown in FIG. 2 and comprises post development member 47 which is closely spaced to photoconductive belt 10 and a conventional ultrasonic probe 48 in contact with the photoconductive belt. Ultrasonic probe 48 is adapted to vibrate photoconductive belt 10 and post development member 47 is actuated simultaneously once a second image has been placed onto the photoconductive belt 10 and developed by developer in developer housing 34. The post development member 47 can be an electrode which has a D.C. bias that establishes a cleaning field for the background toner of the first developed image. The vibrations of the photoconductive belt 10 and the toner by ultrasonic probe 48 causes the toner in images areas to redistribute in accordance with the electric fields, and the background toner of the first developed image to transfer to the electrode. The electrode should be cleaned for cyclic operation.

In operation, a sheet of support material 58 is moved into contact with the toner image at transfer station D. The sheet of support material is advanced to transfer station D by a conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with photoconductive surface of belt 10 in a timed sequence so that the toner powder image developed thereon contacts the advancing sheet of support material at transfer station D. Post development electrode 46 is actuated once the highlight or second image is developed in order to improve image edge smoothness and background cleanliness prior to the composite developed image reaching the transfer station D.

Because the composite image developed on the photoreceptor consists of both positive and negative toner, a pretransfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute guides the advancing sheet 58 to a catch tray (not shown) for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F.

Subsequent to cleaning, a discharge lamp (not shown) floods the photoconductive surface with light to dissipate any residual electrostatic charge remaining prior to the charging thereof for the successive imaging cycle.

While the present image enhancing invention has been described in a preferred tri-level imaging embodiment employing two component development, it should be understood that the invention is equally effective in image development systems in general, especially those that use a single development station (monochrome), multi-development stations (e.g., process color), single component toner, three component developer or in image on image electrostatic systems.

It is, therefore, evident that there has been provided in accordance with the present invention an image forming method and apparatus which forms images that are fringe-free and possess a high fidelity (i.e. a faithful reproduction of the original image) even when optically formed that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. Apparatus for diminishing edge raggedness and background from tri-level images, said apparatus comprising:

means for forming a tri-level latent electrostatic image on a charge retentive surface, said image comprising a first image area at a relatively high voltage level, a second image area at a relatively low voltage level and a background area half way between the voltage levels of said relatively high and low voltage levels;

a first development system including means for applying a first conductive magnetic brush developer to said charge retentive surface for developing a first image area and means for electrically biasing a first developer member to a voltage level that is offset from said background area, in the direction of said first image, a second development system including means for applying a second conductive magnetic brush developer to said charge retentive surface for developing said second image area in a color different from said first image area and means for electrically biasing a second developer member to a voltage level that is offset from said background area, in the direction of said second image area; and a dipole post development member positioned downstream of said second development system, said dipole development member being adapted to remove low charge toner particles of both polarities to reduce line growth of the tri-level images and thereby diminish edge raggedness and background from the tri-level images.

2. The apparatus of claim 1, wherein said dipole post development member includes a D.C. biased A.C. potential.

3. The apparatus of claim 1, wherein said dipole post development member is adapted to triboelectrically recharge toner of said second developed image area.

4. The apparatus of claim 1, including a vibrator member for vibrating said charge retentive surface simultaneously with reestablishing the imaging fields of said first image area.

5. The apparatus of claim 4, wherein said vibrator member is an ultrasonic probe.

6. The apparatus of claim 4, wherein said dipole post development member includes a D.C. bias.

7. The apparatus of claim 6, wherein said dipole post development member is spaced about 10 mils away from said charge retentive member.

8. The apparatus of claim 7, wherein said dipole post development member is an electrode.

9. The apparatus of claim 1, wherein said dipole post development member is an electrode.

10. The apparatus of claim 9, wherein said dipole electrode creates a cleaning electric field for the background toner on said first developed image area.

11. The apparatus of claim 10, wherein said dipole electrode is spaced about 0.001 inches to about 0.030 inches away from said charge retentive member such that toner particles jump back and forth between said electrode and said charge retentive member.

12. In a printing apparatus that includes means for forming a tri-level latent electrostatic image on a charge retentive surface, said image comprising a first image area at a relatively high voltage level, a second image area at a relatively low voltage level and a background area half way between the voltage levels of said relatively high and low voltage levels; a first development system including means for applying a first conductive magnetic brush developer to said charge retentive surface for developing a first image area and means for electrically biasing a first developer member to a voltage level that is offset from said background area, in the direction of said first image; a second development system including means for applying a second conductive magnetic brush developer to said charge retentive surface for developing said second image area in a color different from said first image area and means for electrically biasing a second developer member to a voltage level that is offset from said background area, in the direction of said second image area; the improvement for removing edge raggedness and background from the tri-level images, comprising:

a dipole post development member positioned downstream of said second development system, said dipole development member being adapted to remove low charge toner particles of both polarities from both first and second images to reduce line growth of the tri-level images and thereby diminish edge raggedness and background from the tri-level images.

13. The apparatus of claim 12, wherein said dipole post development member includes a D.C. biased A.C. potential.

14. The printing apparatus of claim 12, wherein said dipole post development member is adapted to triboelectrically recharge toner of said second developed image area.

15. The apparatus of claim 12, including a vibrator member for vibrating said charge retentive surface simultaneously with reestablishing the imaging fields of said first image area.

16. The apparatus of claim 15, wherein said vibrator member is an ultrasonic probe.

17. The apparatus of claim 12, wherein said post development member is an electrode.

18. Apparatus for ensuring the development of edges and reducing the solid area image noise of the previously developed image, said apparatus comprising:

means for forming an electrostatic image on a charge retentive surface;

a development apparatus for rendering said image visible; and a dipole post development member positioned downstream of said development apparatus to reduce solid area image noise and/or remove edge raggedness from said image.

19. The apparatus of claim 18, wherein said dipole post development member includes a D.C. biased A.C. potential.

20. The apparatus of claim 18, including a vibrator member for vibrating said charge retentive surface simultaneously with reestablishing the imaging fields of said first image area.

21. The apparatus of claim 20, wherein said dipole post development member includes a D.C. bias.

22. The apparatus of claim 18, wherein said dipole post development member is an electrode.

23. The apparatus of claim 22, wherein said electrode creates a cleaning electric field for the background toner on said developed image.

* * * * *